US009222341B2

(12) United States Patent
Noui-Mehidi

(10) Patent No.: US 9,222,341 B2
(45) Date of Patent: Dec. 29, 2015

(54) METHOD AND APPARATUS FOR ARTIFICIAL LIFT USING WELL FLUID ELECTROLYSIS

(71) Applicant: Saudi Arabian Oil Company, Dhahran (SA)

(72) Inventor: Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 587 days.

(21) Appl. No.: 13/667,023

(22) Filed: Nov. 2, 2012

(65) Prior Publication Data

US 2013/0105174 A1 May 2, 2013

Related U.S. Application Data

(60) Provisional application No. 61/554,567, filed on Nov. 2, 2011.

(51) Int. Cl.
*E21B 43/18* (2006.01)
*E21B 43/12* (2006.01)

(52) U.S. Cl.
CPC ..... *E21B 43/122* (2013.01)

(58) Field of Classification Search
CPC ... E21B 43/122; E21B 43/16; E21B 43/2401; C25B 1/04; C25B 1/02; B01J 19/0013; C02F 1/20
See application file for complete search history.

(56) References Cited

U.S. PATENT DOCUMENTS

| | | | | |
|---|---|---|---|---|
| 1,784,214 A | | 12/1930 | Workman | |
| 2,799,641 A | * | 7/1957 | Bell | 166/248 |
| 3,417,823 A | * | 12/1968 | Faris | 166/248 |
| 3,724,543 A | | 4/1973 | Bell et al. | |
| 3,782,465 A | | 1/1974 | Bell et al. | |
| 4,037,655 A | | 7/1977 | Carpenter | |
| 4,199,025 A | | 4/1980 | Carpenter | |
| 4,204,923 A | | 5/1980 | Carpenter | |
| 4,919,201 A | * | 4/1990 | Bridges et al. | 166/60 |
| 5,452,763 A | | 9/1995 | Owen | |

(Continued)

OTHER PUBLICATIONS

PCT International Search Report and the Written Opinion of the International Searching Authority dated Oct. 2, 2013; International Application No. PCT/US2012/063160; International File Date: Nov. 2, 2012.

*Primary Examiner* — Daniel P Stephenson
(74) *Attorney, Agent, or Firm* — Bracewell & Giuliani LLP; Constance G. Rhebergen; Linda L. Morgan

(57) ABSTRACT

An artificial lift device is useful for inducing artificial gas lift in a well bore fluid present in a horizontal well bore system using electrically conductive aqueous solution. The artificial lift device includes an ion exchange membrane, an electrode pair having an anode and a cathode separated by the ion exchange membrane, a sensor operable to detect the presence of solution and a power relay operable to selectively permit the electrode pair to receive electrical power. The artificial lift device is operable to form hydrogen product gas bubbles from hydrogen product gas. A method for providing artificial gas lift using the artificial lift device includes forming a horizontal well bore system having a well boot, introducing the artificial lift device into the well bore system, introducing electrical power to the electrode pair, and operating the device to introduce hydrogen product gas bubbles into the horizontal well bore system.

37 Claims, 2 Drawing Sheets

(56) References Cited

U.S. PATENT DOCUMENTS

| | | | | |
|---|---|---|---|---|
| 7,325,604 | B2 * | 2/2008 | Wittle et al. | 166/248 |
| 8,156,954 | B2 * | 4/2012 | Tao et al. | 137/13 |
| 2005/0098443 | A1 * | 5/2005 | Gomez | 205/637 |
| 2007/0000841 | A1 * | 1/2007 | Harrington et al. | 210/703 |
| 2013/0105174 | A1 * | 5/2013 | Noui-Mehidi | 166/372 |
| 2015/0027722 | A1 * | 1/2015 | Al-Mulhem et al. | 166/372 |

* cited by examiner

METHOD AND APPARATUS FOR ARTIFICIAL LIFT USING WELL FLUID ELECTROLYSIS

CROSS-REFERENCE TO RELATED PATENT APPLICATIONS

This application claims priority from U.S. Provisional Application No. 61/554,567, filed Nov. 2, 2011. For purposes of United States patent practice, this application incorporates the contents of the Provisional Application by reference in its entirety.

BACKGROUND OF THE INVENTION

1. Field of the Invention

The field of invention is associated with providing artificial lift to a well producing hydrocarbon fluid. More specifically, the field relates to providing artificial lift using an electrochemical gas lift apparatus and method.

2. Description of the Related Art

At the beginning of the hydrocarbon fluid production cycle, the fluid pressure trapped in the hydrocarbon-bearing formation is operable to drive hydrocarbon fluid to the surface through a pre-formed well bore without additional production assistance. The pressure difference between the fluid head pressure present in the well bore and the pressure of the hydrocarbon fluid in the hydrocarbon-bearing is sufficient to have consistent and predictable production of hydrocarbon fluids from the well bore for a time into the future—potentially years.

Eventually, the pressure in the hydrocarbon-bearing formation diminishes and hydrocarbon fluid production falls. At a certain point, the pressure present in the hydrocarbon-bearing formation is no longer sufficient to produce hydrocarbon fluid at a desirable hydrocarbon fluid flow rate.

Artificial lift techniques can assist in producing hydrocarbon fluids at a desired flow rate. Electric submersible pumps (ESPs) push hydrocarbon liquids to the surface by boosting their pressure downhole. Surface pumps reduce the liquid head pressure and pull hydrocarbon liquids to the surface. Hydraulic injection systems can introduce fluid into the well to drive hydrocarbon liquids to the surface by powering subsurface pumps. Hydraulic injection systems can introduce chemicals into the well bore that lower the viscosity of the hydrocarbons downhole, making them easier to pump uphole. Gas lift systems inject compressed gas to the bottom of the well to help reduce hydrocarbon fluid head pressure by lowering the density of the fluid uphole.

Current gas lift systems suffer from major flaws. First, they require a constant and large source of compressible gas to inject into the well to provide an effective amount of fluid lift downhole. Due to the difference in pressure between the surface and the bottom of the well, a large amount of surface gas is required to achieve desirable amounts of gas lift of the bottom due to compression. A fixed gas injection system with a pipeline to a reliable gas production source or an on-site system with storage facilities in a remote location is very expensive to construct and can be operationally unreliable. Second, the compressed gas, pressurized to overcome the fluid head pressure at the point of discharge downhole, is cold—possibly well below the freezing temperature of water. Raw hydrocarbon fluids contain formation water and hydrocarbon gases that can freeze and form complex hydrocarbon hydrates when in contact with cold surfaces. Clathrates tend to build up against cold surfaces and block fluid flow pathways. Production downtime and intervention to break apart a frozen well bore is expensive. Finally, the selection of injection gases is problematic. Using air introduces a lot of oxygen and some carbon dioxide, which surface gas processing systems must remove from the produced associated gas. These compounds can also form reactive species in the well bore environment that interact with the hydrocarbon and non-hydrocarbon bearing formation in undesirable ways. Pre-refined and on-site separated atmospheric gas processing is expensive, requiring specialized transportation, storage and pre-heating facilities before use.

Electrolysis is the passage of an electrical current through an electrolyte and migration of disassociated charged ions to opposite-charged electrodes. Electrolysis of an electrically-conductive aqueous solution can produce both hydrogen and halogen gases (that is, chlorine, fluorine, bromine, and iodine) as reaction products from solutions containing dissolved metal halides, including salts and minerals, for example, NaCl, $CaCl_2$, $MgCl_2$, $CaSO_4$, $Na_2SO_4$, $MgBr_2$, NaBr and KCl. Electrolysis of an aqueous solution of metal halide containing sodium can produce a halogen gas and a hydrogen gas as shown in Equation 1:

$$2NaX(aq.)+2H_2O(l)\rightarrow X_2(g)+2NaOH(aq.)+H_2(g) \quad \text{(Eq. 1)},$$

where X is the halogen specie. The halogen gas forms at the anode ("anode product gas") and hydrogen gas forms at the cathode ("cathode product gas"). In addition, a small amount of hydroxide ions can disassociate at the anode and provide a small amount of by-product oxygen as shown in Equation 2:

$$4OH—(aq.)\rightarrow 2H_2O(l)+O_2(g) \quad \text{(Eq. 2)}.$$

If hydrogen gas and halogen gas recombine at any point, the two gases can form a hydrogen-halogen gas as shown in Equation 3, which in the aqueous solution environment can then form an acidic solution as shown in Equation 4:

$$H_2(g)+X_2(g)\rightarrow 2HX(g) \quad \text{(Eq. 3), and}$$

$$HX(g)+H_2O(l)\rightarrow HX(aq.)+H_2O(l) \quad \text{(Eq. 4)}.$$

SUMMARY OF THE INVENTION

An artificial lift device is useful for inducing artificial gas lift in a well bore fluid present in a horizontal well bore system. The artificial lift device uses an electrically conductive aqueous solution present in the horizontal well bore. The artificial lift device includes an ion exchange membrane and an electrode pair having an anode and a cathode. The ion exchange membrane separates the anode and cathode. The electrode pair is operable to induce electrolysis in the electrically conductive aqueous solution using electrical power, forming a halogen product gas and a hydrogen product gas. The artificial lift device includes a sensor operable to detect the presence of the electrically conductive aqueous solution in the horizontal well bore system. The sensor transmits an associated signal in response to the detected solution. The artificial lift device includes a power relay operable to selectively permit the electrode pair to receive electrical power. The artificial lift device is operable to receive electrical power from the power source, to form hydrogen product gas bubbles from the hydrogen product gas, and to introduce hydrogen product gas bubbles into an exterior fluid. An embodiment of the artificial lift device is operable to form hydrogen product gas bubbles from the halogen product gas and to introduce halogen product gas bubbles into the exterior fluid.

A method for providing artificial gas lift to a well bore fluid in a horizontal well bore system using an artificial lift device includes the step of forming a horizontal well bore system.

The horizontal well bore system has a vertical section, a horizontal run and a well boot. The well boot is positioned at a greater vertical depth than the horizontal run. The well boot is operable to contain the electrically conductive aqueous solution. The method includes the step of introducing the artificial lift device, which has an electrode pair, into the horizontal well bore system such that the electrode pair are immersed in the electrically conductive aqueous solution contained in the well boot. The method includes the step of introducing electrical power to the electrode pair. Introducing electrical power to the electrode pair immersed in electrically conductive aqueous solution produces a hydrogen product gas and a halogen product gas. The method includes the step of operating the artificial lift device to introduce hydrogen product gas bubbles into the horizontal well bore system. The hydrogen product gas bubbles provide artificial gas lift to the well bore fluid contained in the horizontal well bore system. An embodiment of the method includes operating the artificial lift device such that the artificial lift device introduces the halogen product gas bubbles into the horizontal well bore system.

The artificial lift device introduces product gas bubbles into the well bore fluid. The product gas bubbles provide artificial lift to the well bore fluid, which contains hydrocarbon fluids from the hydrocarbon-bearing formation. Gas bubbles generated downhole and introduced into the hydrocarbon fluid provide artificial lift by expansion, which reduces the fluid density uphole and therefore fluid column head pressure. Due to the pressure difference between the surface and downhole, the needed volume of product gas generated downhole to achieve artificial lift is very small compared to the needed volume of gas at the surface to compress, inject and pump to the bottom to achieve the same artificial lift.

The artificial lift process is mechanical in nature. The product gases generated downhole are more buoyant than the fluids produced by the hydrocarbon-bearing formation. Gas bubbles formed downhole migrate upward towards the surface through the fluid in the well bore. As the gas bubbles traverse upwards, the hydrostatic pressure on the gas bubbles decreases. As the fluid pressure decreases, the volume of the gas bubbles increases. The expanding gas bubbles push against the well bore fluid. In addition, the gas bubbles occupy a larger percentage of a given volume of well bore fluid/gas bubbles as the fluid/gas combination approaches the surface. The well bore fluid becomes less dense as it approaches the surface. The decline in fluid density in turn causes a reduction in total hydrostatic head pressure, which permits greater fluid flow and hydrocarbon production from the hydrocarbon-bearing formation.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
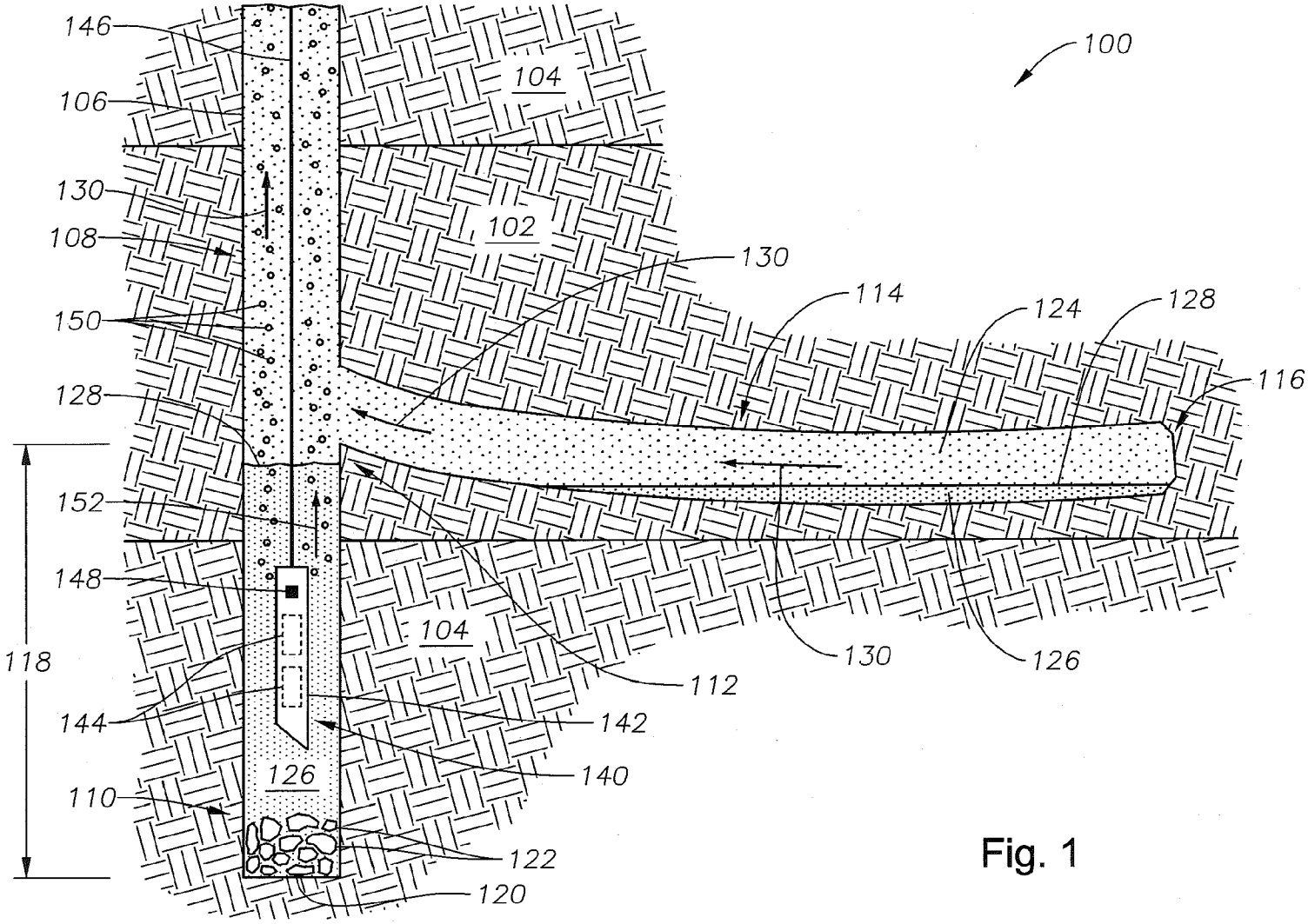
FIG. 1 shows an embodiment of an artificial lift device in use in a horizontal well bore system.

In the accompanying Figures, similar components or features, or both, may have the same or similar reference label.

DETAILED DESCRIPTION OF THE PREFERRED EMBODIMENTS

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operational" and its various forms means fit for its proper functioning and intended use.

Spatial terms describe the relative position of an object or a group of objects relative to another object or group of objects. The spatial relationships apply along vertical and horizontal axes. Orientation and relational words including "uphole" and "downhole"; "upstring" and "downstring"; "above" and "below"; "up" and "down" and other like terms are for descriptive convenience and are not limiting unless otherwise indicated.

Where a range of values is provided in the Specification or in the appended Claims, it is understood that the interval encompasses each intervening value between the upper limit and the lower limit as well as the upper limit and the lower limit. The invention encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

"Tripping" describes the act of moving the drill string or segments of the drill string into and out of the well bore. "Tripping in" refers to introducing the drill string into the well bore. "Tripping out" refers to removing the drill string from the well bore. "Round tripping" refers to removing the drill string from the well bore and then reintroducing the drill string into the well bore after a short interval of time. Modification to the drill string through the addition or subtraction of a tool or specialized equipment can occur when a drill string is being round-tripped.

The "inclination angle" of a well bore is the measure of deviation in angle from true vertical from the perspective of traversing downward through the well bore from the surface. An angle of 0° degree downward is "true vertical". An angle of 90° from true vertical is "true horizontal". A "horizontal run", "leg", or "section" is a portion of the well bore where the inclination angle of the well bore is equal to or greater than 65° from true vertical, including values above true horizontal up to 115° from true vertical. A "horizontal well" is a well that has a well bore with a horizontal run for a portion of the well bore length. Horizontal wells have other portions of the well bore that are less than 65° in angle, including the vertical run that connects the well bore with the surface through the surface entry point.

A "well bore transition zone" is a portion of the well bore where the angle of inclination changes rapidly over a short distance of well bore length, for example, where the well bore changes from a vertical run to a horizontal run.

FIG. 1

FIG. 1 shows an embodiment of an artificial lift device in use in a horizontal well bore system. FIG. 1 and its description facilitate a better understanding of the artificial lift device and method of its use. In no way should FIG. 1 limit or define the scope of the invention. FIG. 1 is a simple diagram for ease of description.

Well bore system 100 traverses through both hydrocarbon-bearing formation 102 and non hydrocarbon-bearing formation 104. Horizontal well bore system 106 forms a fluid pathway between the surface (not shown) and hydrocarbon-bearing formation 102. Horizontal well bore system 106 has several sections, including vertical section 108, well boot 110, well heel 112, horizontal leg 114 and well toe 116. Well boot 110 is an extension or continuation of vertical section 108. Well boot depth 118 is the vertical distance between well heel 112 and well boot bottom 120. Rubble 122 is present at well boot bottom 120. Most of well boot 110 passes through non-hydrocarbon bearing formation 104; however, a small portion of well boot 110 is located in hydrocarbon-bearing formation 102.

Well bore fluid 124 fills most of horizontal well bore system 106. Formation water 126, which is immiscible with hydrocarbon fluids, is present in part of horizontal leg 114 and in well boot 110. Oil-water interface 128 is present where formation water 126 contacts well bore fluid 124. Well bore fluid 124 from hydrocarbon-bearing formation 102 flows along horizontal leg 114 in direction (arrows 130) from well toe 116 towards well heel 112, upward into vertical section 108 above well boot 110 and towards the surface.

FIG. 1 shows the position of artificial lift device 140 in non-hydrocarbon bearing portion 104 of well boot 110. Artificial lift device 140 includes exterior body 142 and electrodes 144 (shown internally). Formation water 126 in well boot 110 immerses artificial lift device 140 completely, including electrodes 144. Power conduit 146 couples to artificial lift device 140 and is operable to convey electrical power from an external power source at the surface (not shown) to artificial lift device 140. Power conduit 146 also suspends artificial lift device 130 in well boot 110, and is operable to introduce and extract artificial lift device 140 from horizontal well bore system 106. Artificial lift device 140 also includes water sensor 148, which is operable to detect an electrically conductive aqueous solutions. Water level sensor 148 is vertically uphole of electrodes 144.

FIG. 1 shows artificial lift device 140 provides artificial gas lift to well bore fluid 124 located in vertical section 108. Product gas bubbles 150 produced by artificial lift device 140 travel in a generally vertical upwards direction (arrow 152) through formation water 126, past oil-water interface 128, and into well bore fluid 124 in vertical section 108. Product gas bubbles 150 merge into well bore fluid flow (arrows 130) and provide artificial lift as both progress uphole towards the surface.

FIG. 2

Figure 2:
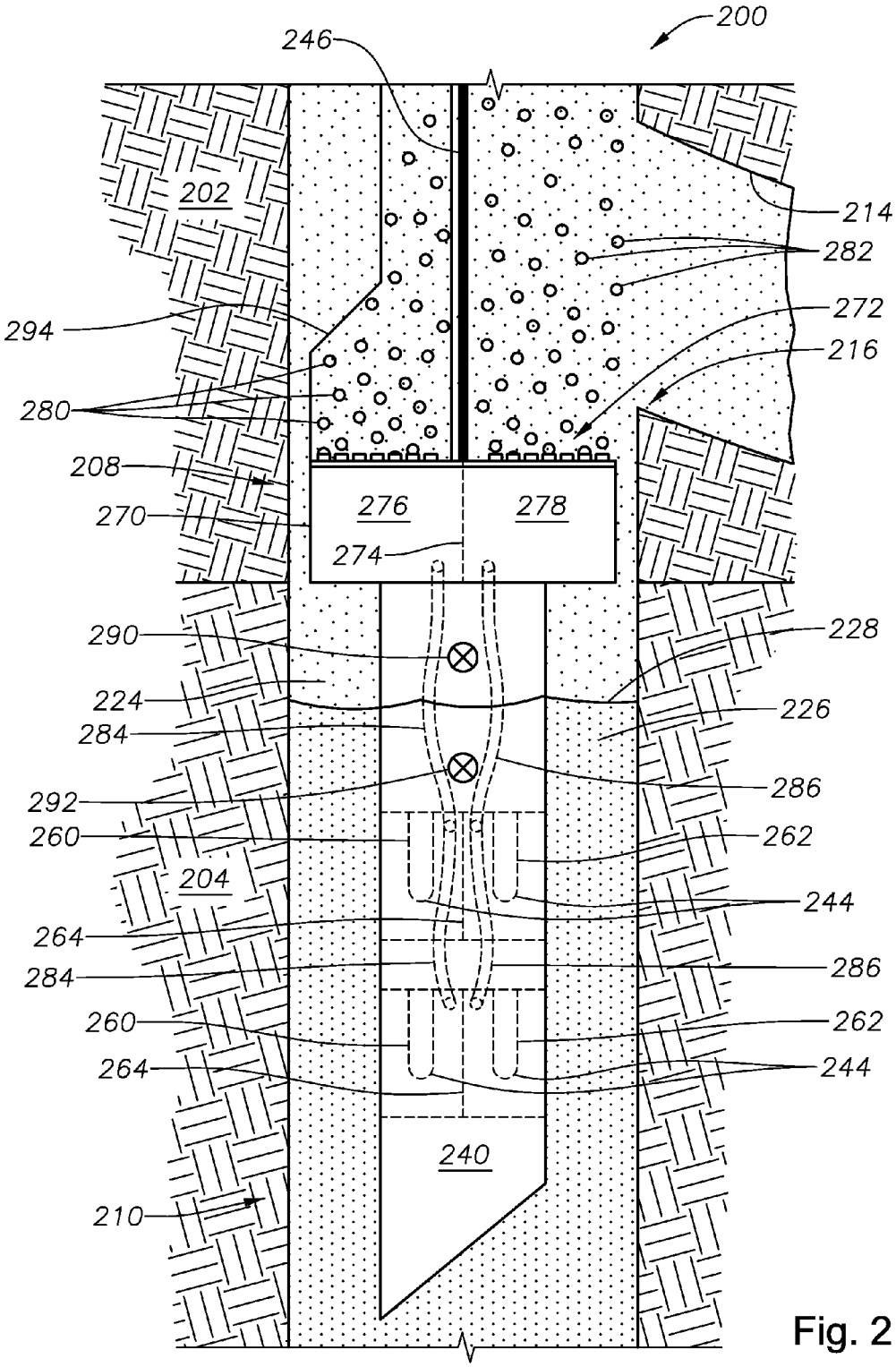
FIG. 2 shows another embodiment of an artificial lift device in use in a horizontal well bore system.

FIG. 2 shows another embodiment of an artificial lift device in use in a horizontal well bore system. FIG. 2 and its description facilitate a better understanding of the artificial lift device and method of its use. In no way should FIG. 2 limit or define the scope of the invention. FIG. 2 is a simple diagram for ease of description.

In FIG. 2, well boot 210 traverses through hydrocarbon-bearing portion 202 and non hydrocarbon-bearing portion 204. Well boot 210 contains both well bore fluid 224, which includes hydrocarbons, and formation water 226. Oil-water interface 228 divides the two fluids.

Power conduit 246 suspends artificial lift device 240 such that the upper portion of artificial lift device 240 is present in well bore fluid 224 and the lower portion is in formation water 226 in well boot 210. Artificial lift device 240 contains two separate pairs of electrodes 244 (shown internally) that couple to power conduit 246. Each electrode pair 244 has anode 260 and cathode 262. FIG. 2 shows artificial lift device 240 having ion exchange membrane 264 (shown internally) located such that it separates each anode 260 from each cathode 262.

Artificial lift device 240 includes bifurcated sparger 270 with bubble cap 272. Separator 274 (shown internally) divides bifurcated sparger 270 into anode service side 276 and cathode service side 278. Anode gas conduit 284 couples anode service side 276 of bifurcated sparger 270 to each anode 260. Anode gas conduit 284 is operable to convey anode product gas from each anode 260 to bifurcated sparger 270. Cathode gas conduit 286 couples cathode service side 278 of bifurcated sparger 270 to each cathode 262. Cathode gas conduit 286 is operable to convey the buoyant cathode product gas product from each cathode 260 to bifurcated sparger 270. Bifurcated sparger 270 distributes both halogen product gas bubbles 280 and hydrogen product gas bubbles 282 directly into well bore fluid 224 using bubble cap 272 separately and simultaneously.

Artificial lift device 240 includes upper water level sensor 290 and lower water level sensor 292. Sensors 290 and 292 are in a relative vertical relationship with one another. FIG. 2 shows artificial lift device 240 bridging oil-water interface 228. Bifurcated sparger 270 is uphole of oil-water interface 228 in fluid contact with well bore fluid 224. Both pairs of electrodes 244 are downhole of oil-water interface 228 and in fluid contact with formation water 226. Well bore fluid 224 immerses upper water level sensor 290 whereas formation water 226 contacts lower water level sensor 292. The position of oil-water interface 228 is between sensors 290 and 292.

Artificial Lift Device

The artificial lift device is operable to induce electrolysis in electrically conductive aqueous solutions, including formation water, to provide artificial gas lift to wellbore fluid that contains hydrocarbon fluids. The electrolysis of the electrically conductive aqueous solution produces for introduction into the wellbore at least one type of product gas bubbles. Product gases forms from the reduction-oxidation ("redox") reactions shown in Equations 1 and 2.

The redox reaction of dissolved salts and minerals in the electrically conductive aqueous solution occurs using an electrolysis cell. The electrolysis cell includes an electrode pair coupled to a power source. The power source induces a voltage differential sufficient to produce the redox reactions in the electrolyte. The space between the electrode pair is such that current does not pass from one electrode to the other before inducing electrolysis in the electrically conductive aqueous solution.

The product gases tend to aggregate around the associated electrode and form product gas bubbles. Lift and surface tension eventually causes the bubbles to detach and migrate towards the surface. The product gas bubbles migrate upwards through all the liquids in the horizontal well bore system.

Electrode Pair

The artificial lift device includes an electrode pair. The electrode pair has an anode and a cathode. The electrodes couple to and receive electrical power from a source of power either internal or external to the artificial lift device. When each electrode pair receives sufficient electrical power, they are operable to induce electrolysis in and generate product gases from the electrically conductive aqueous solution in fluid communication with the electrodes. An embodiment of the artificial lift device has more than one electrode pair, including electrode arrays.

The position of the electrode pair is anywhere on or in the artificial lift device. An embodiment of the artificial lift device includes configurations housing the electrode pair internally. Internal housing can protect the electrode pair directly from the harsh physical and chemical conditions of the well bore. Internal housing also provides protection for the electrodes from fluid contact with hydrocarbons during introduction and transport through the well bore.

The electrodes can take shapes and configurations generally known in the art, including bars, rods, sheets and films. Shapes and compositions support high current densities ($\geq 1$ A/cm$^2$). Complex and three-dimensional geometries increase the current contact surface area. Examples of high current density forms include clusters of thin rods or spirals; meshes; bundles of microfibers and woven strands; open-cellular structures akin to reticulated vitreous carbon (RVC); arrays of single and multi-walled tubes and cylinders, including those found to occur with carbon nanotubes; spheroids inside a fluidly communicative container; and high-surface area porous particles, granules and powders, including graphitized mesoporous carbons (GMCs).

A variety of known compositions is useful as the material of composition for the electrodes, including metals, metal oxides, carbon, conductive polymers, semiconductors and ceramics. Example metals include titanium, iron, copper, platinum (with iridium or rubidium for added strength), nickel, zinc, tin and stainless steel. Metal electrodes can incorporate mixed metal oxides (MMOs) to improve selectivity and longevity. Examples of carbon-based electrodes include particle carbon, pre-treated naturally occurring graphite and artificially created graphite (for example, carbonizing petroleum coke, oil or coal tar pitch). An embodiment of the electrode pair has a material of construction that supports high current densities ($\geq 1$ A/cm$^2$) without significant degradation.

While not intending to be bound by theory, it is noted that the process of electrolysis can create a convective fluid flow around the electrodes. Product gas bubbles moving upwards via buoyancy detach and move away from the electrodes, creating a pulling force that moves electrically conductive aqueous solution towards the surface of the electrodes. The production of product gases induces flow near the surface of the electrodes that draws in fresh electrically conductive aqueous solution. Depleted electrically conductive aqueous solution, which has less salt and dissolved minerals than fresh electrically conductive aqueous solution, flows away under the motion of the product gas bubbles and diffuses into fresh electrically conductive aqueous solution. An embodiment of the artificial lift devices includes a fluid driver, including an impeller, which provides fresh electrically conductive aqueous solution into the surface of the electrodes and causes detachment of product gas bubbles from the electrode surface.

Ion Exchange Membrane

The artificial lift device includes an ion exchange membrane. The position of the ion exchange membrane is between the anode and cathode of each electrode pair. The ion exchange membrane is operable to permit only ions to pass through the membrane and between the electrode pair. The ion exchange membrane prevents non-ions, including water, dissolved salts and minerals, from diffusing through the membrane. Preventing free fluid flow does not allow the formation of aqueous acids via Equations 3 and 4 in the artificial lift device.

An embodiment of the artificial lift device includes a cation exchange membrane positioned between the electrode pair. The cation exchange membrane is a type of ion exchange membrane that only permits one-way ion communication—cations—between the anode and the cathode. Anions cannot pass through the cation exchange membrane. An example of a cation exchange membrane includes NAFION perfluorinated materials (E. I du Pont de Nemours and Co.; Wilmington, Del.).

Product Gas Conduit

An embodiment of the artificial lift device includes a product gas conduit. The product gas conduit for each product gas type prevents intermingling of the different product gases before the artificial lift device forms product gas bubble and introduces them into the horizontal well bore system. The location of the product gas conduit is either internal or external.

Configurations of the product gas conduit can permit collection and conveyance of a product gas from multiple electrodes. In an embodiment of the artificial lift device having more than one electrode pair, an anode gas conduit couples to all of the anodes and conveys anode gas and a cathode gas conduit couples to all of the cathodes and conveys cathode gas. The product gas conduit can service anode product gas (that is, halogens), cathode product gas (that is, hydrogen) or both. The product gas conduit material of construction resists halogens for anode gas service and resists hydrogen for cathode gas service.

Separate anode and cathode product gas conduits are useful in conveying the different product gas types to different destinations. An embodiment of the artificial lift device includes an anode and a cathode product gas conduit separately fluidly coupling to the exterior of the artificial lift device. The separate product gas conduits are operable to discharge product gas into the exterior to the artificial lift device as product gas bubbles. Product bubbles—both anode product bubbles and cathode product bubbles—form in the fluid exterior. In an embodiment of the artificial lift device having a bubble sparger, the product gas conduit passes the product gas into the sparger for product gas aggregation, product gas bubble formation and distribution into the exterior fluid. An embodiment of the artificial lift device includes where the product gas conduit couples to an external conduit that is fluidly connected with the surface. An example of such an external conduit is a surface halogen conduit 294 that is operable to convey halogen product gas directly to the surface.

Bubble Sparger

An embodiment of the artificial lift system includes a bubble sparger. The bubble sparger is operable to receive product gas, form product gas bubbles and introduce the product gas bubbles into the fluid external to the bubble sparger. In an embodiment of the artificial lift system having a product gas conduit, the product gas conduit couples with the bubble sparger and passes product gas into it.

The bubble gas sparger is operable to distribute product gas bubbles into the fluid exterior to the artificial lift system. The bubble gas sparger uses a cap or cover with holes that fluidly yet restrictively couples the interior of the bubble gas sparger with the fluid exterior to the artificial lift system. The holes are operable to both facilitate the formation of gas bubbles in the exterior fluid and cause the release of the gas bubbles from the cap or cover when the product gas bubbles reach a pre-determined size, volume or diameter. An embodiment of the artificial lift system includes a bubble sparger operable to distribute product gas bubbles into the well bore fluid. An embodiment of the artificial lift system includes a bubble sparger operable to distribute product gas bubbles into the electrically conductive aqueous solution.

Artificial lift systems using a bubble gas sparger can use bubble spargers that handle only a single gas type or multiple gas types simultaneously. An embodiment of the artificial lift system includes having an anode gas sparger operable to distribute halogen product gas bubbles into the exterior fluid. An embodiment of the artificial lift system includes having a cathode gas sparger operable to distribute hydrogen product gas bubbles into the exterior fluid. An artificial lift system can have both an anode gas sparger and a cathode gas sparger. An embodiment of the artificial lift system includes having an internally bifurcated sparger operable to distribute halogen product gas bubbles and hydrogen product gas bubbles into the exterior fluid separately and simultaneously. In such an embodiment, the anode of the artificial lift device couples to anode side and the cathode couples to the cathode side of the bifurcated sparger to maintain separation of the different product gas types. The internally bifurcated sparger has separate internal portions that receive and maintain the different types of product gas separate from one another.

Artificial Lift Device Sensor

The artificial lift device includes a sensor operable to detect a wellbore condition and transmit a signal associated with the detected wellbore condition. Examples of useful sensors and data-acquisition tools include electrical resistivity/conductivity, capacitance, ultrasonic, pH, temperature and pressure indicators. The sensor is operable to transmit a signal in response to the detected wellbore condition. The sensor can provide a "binary" type (that is, on/off or true/false) type of signal or an analog or digital scalar signal associated with and calibrated to a range of detectable wellbore condition values.

Well-understood communications systems, including wireless systems, are operable to transmit the sensor signal to the surface or to local control systems for information, process control actions and data retention. An embodiment of an artificial lift device includes an on-board computer that is operable to receive the signal from the sensor, interpret the signal using a set of logical instructions pre-loaded into computer memory, and transmit a response command signal that induces an action. An example of an induced action is the selective manipulation of the position of a power relay.

The sensor can provide a signal that is useful in positioning the artificial lift device in the well boot. An embodiment of the artificial lift device includes a sensor that is operable to detect the presence of electrically conductive aqueous solution and transmit an associated signal in response to the detected solution. Having a sensor positioned on the artificial lift device uphole to the electrode pair is useful for indicating full immersion of the electrodes in the electrically conductive aqueous solution. Relative spacing and configuration of multiple sensors, such as in a vertical orientation relative to one another, can permit positioning of the artificial lift device such that an upper portion of, the artificial lift device is present in well bore fluid and the remaining lower portion is present in electrically conductive aqueous solution. Detection of the two fluid types adjacent to one another can permit inference and possibly direct detection of the oil-water interface in the well boot.

Artificial Lift Device Material of Construction

The artificial lift device is strong enough and shock-resistant to handle tripping up and down and round tripping the horizontal well bore system as well as withstanding the heated hydrocarbons, briny fluids, sulfurous gases, bumping into rock formations and alkaline/acidic conditions downhole. Examples of materials that provide adequate temperature service, are resistant to chemical attack, and that are resilient enough to withstand repeated physical movement include high-performance metal alloys like HASTELLOY (Haynes Int'l; Kokomo, Ind.), MONEL and INCONEL (Special Metals Corp.; New Hartford, N.Y.); fluoropolymers such as polytetrafluoroethylene (PFTE), perfluoroalkoxy polymers (PFA), polyether ether ketone (PEEK) polymers, fluorinated ethylene propylene polymers (FEP), polyetherimides (PEI) and ethylenetetrafluoroethylene (ETFE) polymers; carbon, stainless and low alloy steels coated or clad with fluoropolymers; fluorinated or chlorinated synthetic rubbers, silicones, and polymer gasket rings and sealants; titanium alloys; nickel alloys; and certain classes of thermosetting polymers like polyimides, polycarbonates and epoxy resins.

Polymer, carbon fiber and ceramic materials that are not only chemically resistant to acidic/alkaline aqueous environments and free-radical halogens but are also electrically non-conductive are useful proximate to the electrodes. These types of materials are also useful as fluid or protective screens and conduits for conveying electrically conductive aqueous solution to and from the electrodes.

Power Source, Power Conduit and Power Relay

The artificial lift device uses electrical energy to conduct electrolysis. The source of power that provides electrical current can be external to the horizontal well bore system. Sources of external electrical power include solar cells, hydrocarbon-driven generators and distributed power lines. The source of power can be internal to the artificial lift device. A battery system can act as a local power source. The form of electrical power is preferably direct current, although the power source can supply alternating current that a coupled transformer converts into direct current for transmission downhole.

Electrical power conduit, including shielded and insulated power cable and wireline, is operable to convey electrical power from the surface to the artificial lift device. The electrical power conduit can also act to introduce into, position within, maintain and remove from the horizontal well bore the artificial lift device.

The amount of electrical power used to induce electrolysis in the electrically conductive aqueous solution is sufficient to form hydrogen product gas and halogen product gas. The amount of power used can vary according to a number of process-related factors, including changing hydrocarbon fluid production rate, product gas bubble generation rate, desired longevity of the electrodes and the position of the oil-water interface in relation to the electrode pair.

The artificial lift device includes a power relay. The power relay is operable to selectively permit or deny power to the electrodes. When the power relay is open, the electrodes cannot receive power and therefore are not operable to perform electrolysis; when the power relay is closed, the electrodes are operable to induce electrolysis in the electrically conductive aqueous solution. The power relay can prevent accidental introduction of power to the electrodes before immersion in electrically conductive aqueous solution, which can damage or destroy the electrodes.

The selective position of the power relay can change based upon manual control or through control by a computer control system based upon instructions loaded into memory. An embodiment of the artificial lift device includes a power relay system where the power relay is operable to receive a signal from the sensor and selectively permit the conveyance of power between the power source and the electrode pair based upon the received associated signal. The position of the sensor in such an embodiment is useful if it is relative to the electrodes such that when the sensor detects electrically conductive aqueous solution the electrodes are immersed in solution. Not receiving the associated signal or upon receiving a different signal from the sensor causes the power relay to remain in an open position.

Other Surface Conduits

An optional surface halogen conduit runs downward from the surface along the vertical section of the horizontal well bore system to a point proximate to the position of the artificial lift device in the well boot. The surface halogen conduit is operable to pass product halogen gases formed by the artificial lift device directly to the surface without introducing the gases or bubbles formed from the gases into any of the fluids in the horizontal well bore system. Examples of suitable materials of construction for the surface halogen conduit and connectors to couple the conduit to the artificial lift device include bronze, polyvinyl chloride (PVC), polyvinylidene difluoride (PVDF), carbon-graphite, tungsten carbide and specialty halogen-resistant stainless steels. A system that selectively diverts produced halogen gases directly to the surface through an optionally surface halogen conduit can prevent the unintentional formation of acid solutions in the horizontal well bore due to inadvertent product gas combination as given with Equations 3 and 4. The surface halogen conduit can couple to and be introduced with the artificial lift device.

An optional surface electrically conductive aqueous solution supply conduit is operable to provide electrically conductive aqueous solution, including artificial brines and previously produced formation water, into the horizontal well bore system, to recycle the fluid and support ongoing operations.

Electrically Conductive Aqueous Solution

The electrolyte useful for conducting the electrolysis reaction of Equations 1 and 2 in the horizontal well bore system is electrically conductive aqueous solution. Examples of electrically conductive aqueous solution include fresh waters, salt waters, seawater, mineral waters, brines and formation water. Hydrocarbon fluids, including oils, liquid gas condensates and natural and associated gases have high dielectric values and are not suitable for inducing large-scale electrolysis for artificial gas lift. Electrically conductive aqueous solution can originate from the surface. Artificially produced electrically conductive aqueous solution include man-made brines using salt dome salts or process residues, seawater and recovered formation water from previously-produced well bore fluid. A separate fluid conduit can introduce the artificially produced electrically conductive aqueous solution into the horizontal well bore system.

Electrically conductive aqueous solution includes formation water, which is water co-produced from the hydrocarbon-bearing formation with hydrocarbon fluids. Formation water is a briny aqueous liquid with a high-concentration of dissolved salts and solubilized minerals. Non-hydrocarbon bearing formations in contact with the horizontal well bore system can also pass formation water. Formation water almost immediately begins separating from produced well bore fluid because it is immiscible with the hydrocarbons in the well bore fluid. Separated formation water also tends to sink to lower portions of the hydrocarbon well bore system, including water traps and the well boot, because it is denser than the well bore fluid.

The oil-water interface forms where an aqueous layer contacts a hydrocarbon layer. Inferring if not determining the location of the oil-water interface is possible using a sensor that is operable to distinguish the differences in physical or chemical properties of hydrocarbon and aqueous fluids. For example, a conductivity sensor can detect the difference in conductivity between the electrically conductive aqueous solution and well bore fluid.

Method of Performing Artificial Lift

A method for providing artificial gas lift to a well bore fluid occurs in a horizontal well bore system. The horizontal well bore system extends from the surface downward through non-hydrocarbon bearing formations in a vertical section. At the kick-off point, which is shallower than the hydrocarbon-bearing formation, the horizontal well bore system transitions in a well bore transition zone from a generally vertical orientation to a generally horizontal orientation. In the well bore transition zone, the horizontal well bore system penetrates and traverses through the hydrocarbon-bearing formation, where the system extends generally in a horizontal direction along the hydrocarbon-bearing formation as a leg or run or section. Multiple horizontal laterals can extend either from the vertical section or from the horizontal leg, or both.

An extension of the vertical section below the horizontal leg is the well boot. The well boot is located at a greater vertical depth than the horizontal leg in which it serves. The well boot is operable to collect and retain electrically conductive aqueous solution. Formation water separating from the well bore fluid collects on the well bore walls and trickles down into the well boot or well bore fluid flowing from the horizontal leg pushes it into the well boot. The aggregated electrically conductive aqueous solution is useful for artificial lift gas generation.

Well boot formation in relationship with the vertical section can allow for easier introduction of the artificial lift device into the well boot from the surface as well as prevent accidental diversion of the artificial lift device into a horizontal leg. An embodiment of the method includes forming a horizontal well bore system with a well boot vertically aligned with the vertical section. An embodiment of the method includes forming a horizontal well bore system with a well boot concentric with the vertical section. An embodiment of the method includes forming a horizontal well bore system with a well boot that has a similar bore gauge as the vertical section.

Locating the well boot in a non-hydrocarbon bearing formation, such as in an underburden, can prevent hydrocarbon fluids from disrupting artificial gas lift bubble production. Producing well bore fluid proximate to the artificial lift device can unintentionally coat the electrode pair, rendering them less effective in performing electrolysis. Some of the electrolysis reaction byproducts form alkaline materials, which can interact with the hydrocarbon-bearing formation an undesirable or unpredictable manner. The non-hydrocarbon bearing formation can also be a convenient source for formation water. An embodiment of the method includes forming a horizontal well bore system with a well boot at least partially located in a non-hydrocarbon bearing formation.

The well boot is deep enough to permit introduction of the artificial lift device into the well boot and to collect enough electrically conductive aqueous solution to produce product gas bubbles. An embodiment of the method includes forming a horizontal well bore system with a well boot having a vertical depth in a range of from about three times to about five times the vertical length of the artificial lift device. The vertical length of the artificial lift device is determinable as length from the uphole-most point of the device to the downhole-most point of the device.

The method for providing artificial gas lift to a well bore fluid in a horizontal well bore system using an artificial lift device includes the step of introducing the artificial lift device having a electrode pair into the horizontal well bore system such that the electrode pair are immersed in the electrically conductive aqueous solution contained in the well boot. Permanent introduction of the artificial lift device can occur by attaching the artificial lift device to the end of casing or production tubing or drill pipe and securing the tubular such that the position of the artificial lift device is in the well boot. Power and other optional conduits can run along the interior of the installed tubular. Temporary introduction includes attaching the artificial lift device to the end of a wireline, power conduit or coiled tubing string and suspending the artificial lift device from the surface of the conduit or cable.

Some artificial lift devices have a sensor operable to detect the presence of electrically conductive aqueous solution. An embodiment of the method includes introducing the artificial lift device such that the sensor detects electrically conductive aqueous solution present in the well boot. A further embodiment of the method includes where the introduction causes the power relay to close, which permits the introduction of electrical power to the electrodes.

An embodiment of the method includes introducing the artificial lift device such that a portion of the artificial lift device is in fluid contact with well bore fluid and the remainder of the artificial lift device is in fluid contact with electrically conductive aqueous solution present in the well boot. In such a position, the artificial lift device crosses the oil-water interface in the well boot. An embodiment of the method includes introducing the artificial lift device such that the electrically conductive aqueous fluid present in the well boot fully immerses the artificial lift device.

An embodiment of the method includes introducing the artificial lift device such that the artificial lift device introduces product gas bubbles directly into the well bore fluid. An embodiment of the method includes introducing the artificial lift device such that the artificial lift device introduces product gas bubbles directly into the electrically conductive aqueous fluid.

Some artificial gas lift devices include a bubble sparger. An embodiment of the method includes introducing the artificial lift device such that the bubble sparger fluidly contacts and introduces product gas bubbles directly into the well bore fluid. An embodiment of the method includes introducing the artificial lift device such that the bubble sparger fluidly contacts and introduces product gas bubbles directly into the electrically conductive aqueous solution.

The method for providing artificial gas lift to a well bore fluid in a horizontal well bore system using an artificial lift device includes the step of introducing electrical power to the electrode pair immersed in the electrically conductive aqueous solution to produce a hydrogen product gas and a halogen product gas. Electrolysis produces a halogen product gas at the anode and a hydrogen product gas at the cathode. An embodiment of the method of using the artificial lift device includes inducing a voltage differential between the electrode pair of from about 2 volts to about 15 volts as measured between the electrodes during operation.

The method for providing artificial gas lift to a well bore fluid in a horizontal well bore system using an artificial lift device includes the step of operating the artificial lift device such that the artificial lift device introduces hydrogen product gas bubbles into the horizontal well bore system. The hydrogen product gas bubbles provide artificial gas lift to the well bore fluid. An embodiment of the method includes operating the artificial lift device such that the artificial lift device introduces halogen product gas bubbles into the horizontal well bore system.

An embodiment of the method includes operating the artificial lift device such that the artificial lift device selectively produces the halogen product gas directly to the surface. The product halogen gas from the electrolysis reaction is highly purified as the product of electrolysis of dissolved salts and minerals. It is useful for additional refining into purified halogen materials for commodity chemical processing. Producing halogen product gases directly to the surface also permits greater use of materials in the horizontal well bore system that are susceptible to chemical attack by halogens, including stainless steel. Diversion also avoids the expense and use of surface treatment systems to remove selectively the halogen product gases and acids from produced well bore fluid. The significant downside is that not using halogen product gas for artificial gas lift leaves only product hydrogen gas to form bubbles and perform the lift. One of ordinary skill in the art can address the various technical and economic considerations in whether to use halogen product gas for performing artificial gas lift or to divert the material to the surface.

An embodiment of the method includes introducing a surface electrically conductive aqueous solution supply conduit into the horizontal well bore system. The surface electrically conductive aqueous solution supply conduit is operable to provide electrically conductive aqueous solution from the surface, including recovered formation water. An embodiment of the method includes introducing the electrically conductive aqueous solution into the horizontal well bore system from the surface. The surface electrically conductive aqueous solution supply conduit can provide electrically conductive aqueous solution into the horizontal well bore system anywhere. If not provided directly into the well boot, the electrically conductive aqueous solution migrates downhole to the well boot. Providing electrically conductive aqueous solution to the horizontal well bore system ensures that adequate supply of solution is present in the well boot for product gas generation. It is also an effective means of disposing of field-separated produced formation water since it requires no additional treatment beyond possibly acid neutralization. Using the previously produced formation water minimizes the amount of make-up or fresh water needed if artificial gas lift outpaces the amount of formation water separating from the well bore fluid downhole.

What is claimed is:

1. An artificial lift device useful for inducing artificial gas lift in a well bore fluid present in a horizontal well bore system using an electrically conductive aqueous solution, the artificial lift device comprising:

an ion exchange membrane;

an electrode pair having an anode and a cathode, where the anode and cathode are separated by the ion exchange membrane and are operable to induce electrolysis in the electrically conductive aqueous solution using electrical power such that a halogen product gas and a hydrogen product gas form;

a sensor operable to detect the presence of the electrically conductive aqueous solution and to transmit an associated signal in response to the detected electrically conductive aqueous solution; and a power relay operable to selectively permit the electrode pair to receive electrical power;

where the artificial lift device is operable to receive electrical power from the power source, to form hydrogen product gas bubbles from hydrogen product gas and to introduce hydrogen product gas bubbles into an exterior fluid.

2. The artificial lift device of claim 1 where the artificial lift device is operable to form halogen product gas bubbles from halogen product gas and to introduce halogen product gas bubbles into the exterior fluid.

3. The artificial lift device of claim 1 where the artificial lift device is operable to pass halogen product gas to the surface through a surface halogen conduit.

4. The artificial lift device of claim 3 where the artificial lift device is selectively operable to pass halogen product gas to the surface.

5. The artificial lift device of claim 1 where the ion exchange membrane is a cation exchange membrane.

6. The artificial lift device of claim 1 where the power relay is operable to receive the associated signal from the sensor and to selectively permit the electrode pair to receive electrical power upon receipt of the associated signal.

7. The artificial lift device of claim 1 further comprising a halogen product gas conduit coupling to the anode and operable to pass the halogen product gas.

8. The artificial lift device of claim 7 where the halogen product gas conduit is operable to pass halogen product gas into the exterior fluid as halogen product gas bubbles.

9. The artificial lift device of claim 1 further comprising a hydrogen product gas conduit coupling to the cathode and operable to pass the hydrogen product gas.

10. The artificial lift device of claim 9 where the hydrogen product gas conduit is operable to pass hydrogen product gas into the exterior fluid as hydrogen product gas bubbles.

11. The artificial lift device of claim 1 where the artificial lift device further comprises a bubble sparger, the bubble sparger operable to receive a product gas, form a product gas bubbles from the product gas, and to introduce the product gas bubbles into the exterior fluid.

12. The artificial lift device of claim 11 where the product gas is hydrogen product gas and the product gas bubbles are hydrogen product gas bubbles.

13. The artificial lift device of claim 11 where the product gas is halogen product gas and the product gas bubbles are halogen product gas bubbles.

14. The artificial lift device of claim 11 where the bubble sparger is operable to receive both hydrogen product gas and halogen product gas separately, to form halogen product gas bubbles from the halogen product gas, to form hydrogen product gas bubbles from the hydrogen product gas, and to introduce the halogen product gas bubbles and the hydrogen product gas bubbles into the exterior fluid separately and simultaneously.

15. The artificial lift device of claim 1 where the exterior fluid is well bore fluid.

16. The artificial lift device of claim 1 where the exterior fluid is electrically conductive aqueous solution.

17. A method for providing artificial gas lift to a well bore fluid in a horizontal well bore system using an artificial lift device, the method for providing artificial gas lift comprising the steps of:

forming a horizontal well bore system having a vertical section, a horizontal run and a well boot such that the well boot is positioned at a greater vertical depth than the horizontal run and is operable to contain the electrically conductive aqueous solution;

introducing the artificial lift device having an electrode pair into the horizontal well bore system such that the electrode pair are immersed in the electrically conductive aqueous solution contained in the well boot;

introducing electrical power to the electrode pair such that a hydrogen product gas and a halogen product gas are produced from the electrically conductive aqueous solution; and operating the artificial lift device such that hydrogen product gas bubbles are introduced into the horizontal well bore system;

where the horizontal well bore system contains both the well bore fluid and an electrically conductive aqueous solution, and where the hydrogen product gas bubbles provide artificial gas lift to the well bore fluid contained in the horizontal well bore system.

18. The method for providing artificial gas lift of claim 17 where the forming step further comprises forming the well boot that is vertically aligned with the vertical section.

19. The method for providing artificial gas lift of claim 17 where the forming step further comprises forming the well boot such that it is concentric with the vertical section.

20. The method for providing artificial gas lift of claim 17 where the forming step further comprises forming the well boot such that it has a similar bore gauge as the vertical section.

21. The method of providing artificial gas lift of claim 17 where the forming step further comprises forming the well boot such that it is located at least partially in a non-hydrocarbon bearing formation.

22. The method of providing artificial gas lift of claim 17 where the forming step further comprises forming the well boot such that it has a vertical depth in a range of from about three times to about five times the vertical length of the artificial lift device.

23. The method of providing artificial gas lift of claim 17 where the introducing artificial lift device step further comprises introducing the artificial lift device, the artificial lifting device having a sensor operable to detect the electrically conductive aqueous solution, to cause the sensor to detect the electrically conductive aqueous solution in the well boot.

24. The method of providing artificial gas lift of claim 23 where the introducing artificial lift device step further comprises introducing the artificial lift device, where the artificial lift device has a power relay operable to selectively permit the introduction of power to the electrode pair and the sensor is operable to transmit a signal upon detection of the electrically conductive aqueous solution, to cause the sensor to transmits a signal associated with the detection of the electrically conductive aqueous solution and the power relay to selectively permits the introduction of electrical power to the electrodes.

25. The method of providing artificial gas lift of claim 17 where the introducing artificial lift device step further comprises introducing the artificial lift device such that a portion of the artificial lift device is in fluid contact with well bore fluid and the remainder of the artificial lift device is in fluid contact with the electrically conductive aqueous solution present in the well boot.

26. The method of providing artificial gas lift of claim 17 where the introducing artificial lift device step further comprises introducing the artificial lift device such that the artificial lift device is fully immersed in the electrically conductive aqueous solution present in the well boot.

27. The method of providing artificial gas lift of claim 17 where the introducing artificial lift device step further comprises introducing the artificial lift device such that the artificial lift device introduces product gas bubbles directly into the well bore fluid.

28. The method of providing artificial gas lift of claim 17 where the introducing artificial lift device step further comprises introducing the artificial lift device such that the artificial lift device introduces product gas bubbles directly into the electrically conductive aqueous fluid.

29. The method of providing artificial gas lift of claim 17 where the introducing artificial lift device step further comprises introducing the artificial lift device, where the artificial lift device has a bubble sparger operable to introduce product gas bubbles into the well bore fluid, such that the bubble sparger fluidly contacts the well bore fluid.

30. The method of providing artificial gas lift of claim 17 where the introducing artificial lift device step further comprises introducing the artificial lift device, where the artificial lift device has a bubble sparger operable to introduce product gas bubbles into the electrically conductive aqueous solution, such that the bubble sparger fluidly contacts the electrically conductive aqueous solution.

31. The method of providing artificial gas lift of claim 17 where the introducing electrical power step further comprises introducing electrical power such that a voltage differential is present between the electrodes having a value in a range of from about 2 volts to about 15 volts.

32. The method of providing artificial gas lift of claim 17 where the operating step further comprises operating the artificial lift device such that the artificial lift device introduces halogen product gas bubbles into the horizontal well bore system.

33. The method of providing artificial gas lift of claim 17 where the operating step further comprises operating the artificial lift device such that the artificial lift device selectively produces the halogen product gas directly to the surface.

34. The method of providing artificial gas lift of claim 17 where the operating step further comprises operating the artificial lift device such that the artificial lift device introduces the halogen product gas bubbles into the horizontal well bore system.

35. The method of providing artificial gas lift of claim 17 further comprising the step of introducing a surface electrically conductive aqueous solution supply conduit into the horizontal well bore system, the surface electrically conductive aqueous solution supply conduit operable to provide electrically conductive aqueous solution from the surface.

36. The method of providing artificial gas lift of claim 35 further comprising the step of introducing the electrically conductive aqueous solution into the horizontal well bore system from the surface.

37. The method of providing artificial gas lift of claim 36 where the electrically conductive aqueous solution introduced from the surface comprises previously produced formation water.

* * * * *